US008640284B2

(12) United States Patent
Farre

(10) Patent No.: US 8,640,284 B2
(45) Date of Patent: Feb. 4, 2014

(54) ARTICULATED AND/OR JOINTED BED

(76) Inventor: Jaume Casteras Farre, Lleida (ES)

( * ) Notice: Subject to any disclaimer, the term of this patent is extended or adjusted under 35 U.S.C. 154(b) by 163 days.

(21) Appl. No.: 13/050,370

(22) Filed: Mar. 17, 2011

(65) Prior Publication Data

US 2012/0233781 A1 Sep. 20, 2012

(51) Int. Cl.
*A61G 7/018* (2006.01)
*A61G 7/015* (2006.01)
*A61G 7/002* (2006.01)

(52) U.S. Cl.
USPC ..... 5/616; 5/600; 5/613

(58) Field of Classification Search
USPC ..... 5/600, 613, 616, 108, 109, 915
See application file for complete search history.

(56) References Cited

U.S. PATENT DOCUMENTS 2,596,986 A * 5/1952 Curtis ..... 280/641
3,672,354 A * 6/1972 Weber ..... 601/150
3,882,556 A * 5/1975 Accurso ..... 5/108
4,094,024 A * 6/1978 Benoit et al. ..... 5/616
4,407,030 A * 10/1983 Elliott ..... 5/616
4,531,730 A * 7/1985 Chenera ..... 482/142
5,040,253 A * 8/1991 Cheng ..... 5/616
5,044,359 A * 9/1991 Reinert ..... 606/243
5,171,260 A * 12/1992 McIlwain ..... 606/243
5,245,718 A * 9/1993 Krauska ..... 5/618
5,282,835 A * 2/1994 Wright et al. ..... 606/242
5,320,640 A * 6/1994 Riddle et al. ..... 606/242
5,468,216 A * 11/1995 Johnson et al. ..... 601/24
6,893,386 B2 * 5/2005 Charoenchit ..... 482/142
7,314,431 B1 * 1/2008 Korotiaev et al. ..... 482/51
7,685,657 B1 * 3/2010 Hernandez et al. ..... 5/109
2009/0235456 A1 * 9/2009 Bock ..... 5/616
2009/0260159 A1 * 10/2009 Buchanan ..... 5/617
2009/0313758 A1 * 12/2009 Menkedick et al. ..... 5/618
2012/0060287 A1 * 3/2012 Dewert et al. ..... 5/600
2013/0074266 A1 * 3/2013 Wu ..... 5/616

* cited by examiner

*Primary Examiner* — Robert G Santos
*Assistant Examiner* — Myles Throop
(74) *Attorney, Agent, or Firm* — Epstein Drangel LLP; Robert L. Epstein

(57) ABSTRACT

The present invention relates to an articulated bed which comprises a perimetric tubular frame, two mattress support portions articulated at the ends opposite to the respective ends of the frame, and articulated to one another at facing ends by means of a common rotating shaft; a geared motor assembled in the frame which rotationally operates a transverse shaft provided with at least one crank coupled by means of a connecting rod with the common shaft for the articulation of the two mattress support portions, transmitting a vertical oscillation to the common shaft and to the facing ends of the mattress support portions. In one embodiment variant it comprises a second geared motor which transmits an longitudinal alternating movement to the mattress support portions by means of a connecting rod-crank mechanism.

6 Claims, 3 Drawing Sheets

ARTICULATED AND/OR JOINTED BED

OBJECT OF THE INVENTION

The present invention relates to an articulated bed, more specifically to a bed intended to provide a vertical oscillating movement in its central part for various uses.

BACKGROUND OF THE INVENTION

There are currently many articulated beds the purpose of which is to allow people who should remain lying down for long periods of time to be able to make themselves more anatomically comfortable, for example by means of raising the front or rear part of the bed.

This articulation of the mattress support of the bed can be achieved by means of drive motors, but in general the bed is not designed to move constantly and cyclically, but rather so that changes can periodically be made between static positions during a certain time.

Other beds intended for the relaxation of the user while lying down and other recreational uses comprise a vibration mechanism to allow moving the mattress support, and therefore the mattress on which the user or users are lying, in a longitudinal direction, causing a state of relaxation or oscillation.

DESCRIPTION OF THE INVENTION

The articulated bed object of this invention has technical particularities intended to offer an oscillating, upward and downward movement in its middle portion cyclically, said movement having various uses.

The articulated bed of the invention is of the aforementioned type and comprises a perimetric tubular frame preferably having a rectangular configuration on which articulated mattress support portions are arranged.

According to the invention, the articulated bed comprises:—two mattress support portions of a length approximately equal to half the length of the frame, articulated at facing ends by means of a common rotating shaft in the middle transverse area of the bed; a first mattress support portion being articulated at one end of the frame, and the second mattress support portion articulated at the opposite end of the frame, and—a geared motor assembled in the frame which rotationally operates a transverse shaft provided with at least one crank coupled by means of a connecting rod with the common shaft for the articulation of the two mattress support portions.

Thus, to start the geared motor, the mechanism formed by the crank and the connecting rod causes the vertical oscillation movement of the common shaft for attaching the two mattress support portions and consequently the alternating movement in a vertical direction in the intermediate area of the mattress. The vertical displacement achieved corresponds with the diameter of the circumference described by the articulation point of the connecting rod with the crank.

This movement causes hip movement in the user which can be used for exercise purposes as a relaxation movement or while practicing sexual intercourse.

In an embodiment of the invention, the transverse shaft has at its ends respective connecting rod and crank mechanisms, the connecting rods being coupled with the common shaft for the articulation of the two mattress support portions. This configuration allows distributing the stress on the common shaft for the articulation in two symmetrical points with respect to the longitudinal shaft of the bed.

According to the invention, the geared motor is assembled in the frame by means of a support made up of two parallel crossbeams having side supports for the transverse shaft, which thus allows transmitting the weight and stress during oscillation to the middle part of the frame.

In an embodiment of the invention, the frame comprises support legs which allow arranging the geared motor and the shaft at a certain height with respect to the floor, preventing interference of the crank with the floor.

The mattress support portions comprise stops in their periphery protruding towards the upper area delimiting the support surface for the mattress and preventing side movements of the mattress during the oscillation of the mattress support.

The connecting rods used to articulate one of the mattress support portions with one of the ends of the frame have the purpose of absorbing the length differences defined by the assembly formed by the two mattress support sectors during the vertical oscillation thereof.

In an embodiment variant the frame additionally comprises a second geared motor the shaft of which is associated with one of the opposite ends of one of the mattress support portions by means of a connecting rod-crank mechanism responsible for transmitting an alternating movement in the longitudinal direction to the mattress support portions.

The incorporation of this second geared motor allows simultaneously or independently transmitting a vertical alternating movement to the mattress support portions in their area of attachment and an alternating movement in a longitudinal direction.

According to the invention, at least one of the mattress support portions is articulated to the frame by means of connecting rods to absorb the length differences of the assembly formed by the mattress support portions during the vertical alternating movement thereof and/or the longitudinal alternating movement thereof.

DESCRIPTION OF THE DRAWINGS

To complement the description being made and for the purpose of aiding to better understand the features of the invention, a set of drawings is attached to the present specification in which the following has been depicted with an illustrative and non-limiting character.

PREFERRED EMBODIMENT OF THE INVENTION

Figure 1:
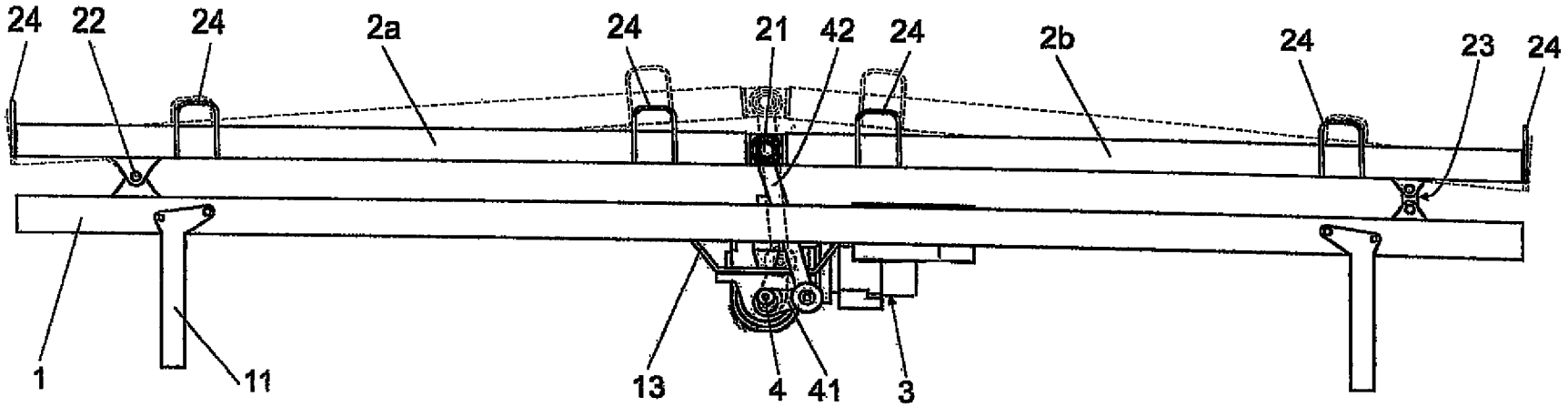
FIG. 1 shows a side view of the articulated bed according to the invention.
Figure 2:
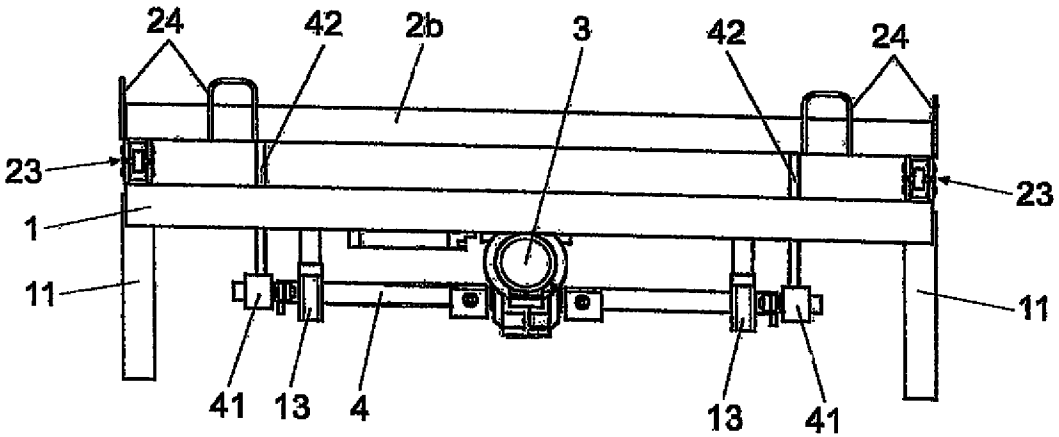
FIG. 2 shows frontal view of the articulated bed.
Figure 3:
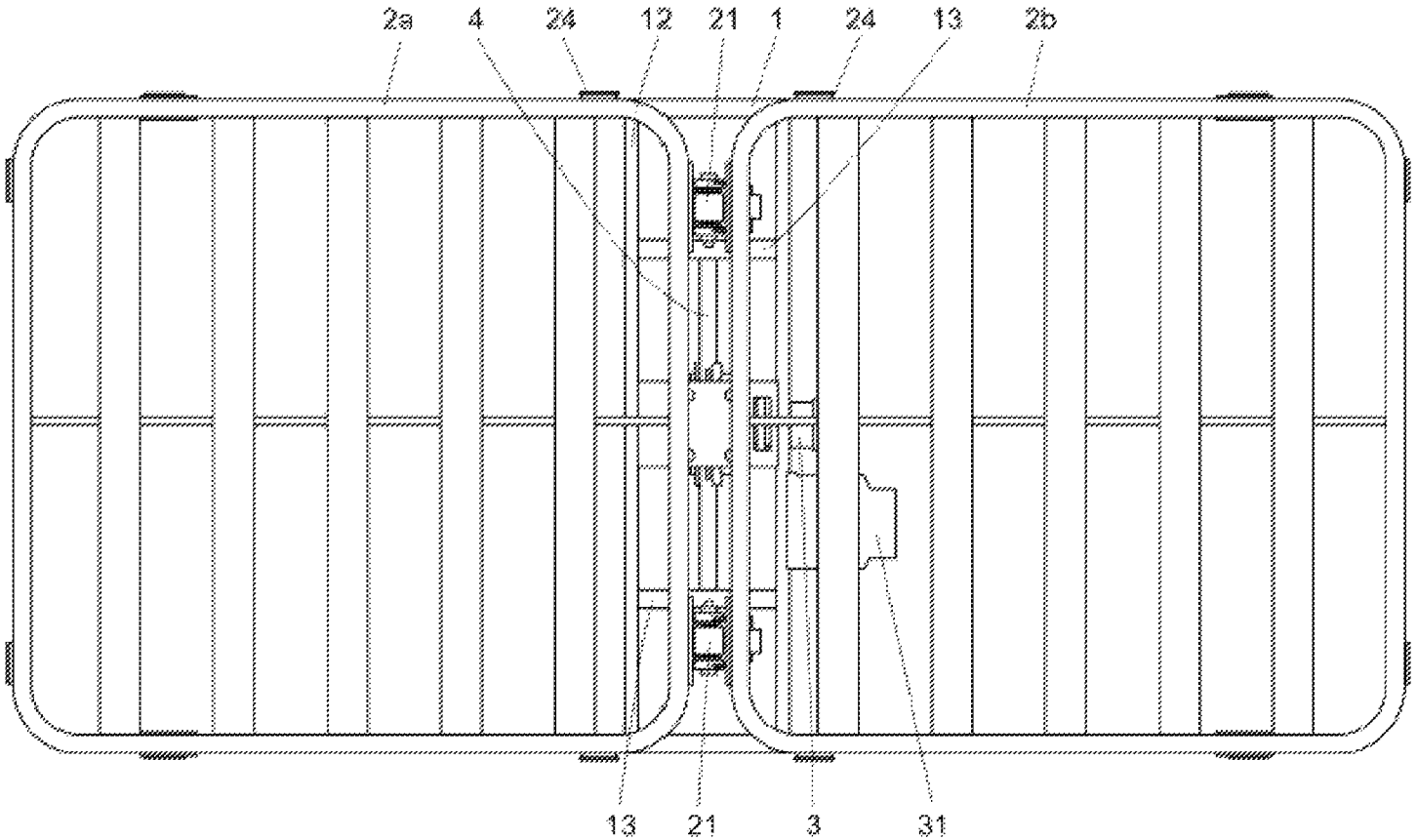
FIG. 3 shows a plan view of the articulated bed.

The articulated bed shown in the embodiment of FIGS. 1 to 3 comprises a perimetric tubular frame (1) having a rectangular configuration, which has support legs (11) in a lower portion, two mattress support portions (2*a* and 2*b*) being arranged on said frame (1) articulated at the facing ends in a common shaft (21) oriented in a transverse direction.

The first mattress support portion (2*a*) is articulated to one of the ends of the frame by means of hinges (22), while the second mattress support portion (2*b*) is articulated to the opposite end of said frame (1) by means of hinge rods (23), wherein the hinge rods comprise two pivot axes and a connecting bar.

The frame (1) comprises in its intermediate area a support (12) in which a geared motor (3) is assembled which rotationally operates a transverse shaft (4) resting on side supports (13).

The transverse shaft (4) has at its ends respective cranks (41) connected by means of respective connecting rods (42) to the common shaft (21) for the articulation of the two mattress support portions (2*a*, 2*b*), such that the rotation of the geared motor (3) causes an oscillation of said common shaft (21) and of the facing ends of the mattress support portions coupled thereto in a vertical direction.

The mattress support portions (2*a* and 2*b*) have stops (24) in their periphery protruding towards the upper area, intended to laterally secure the mattress (not depicted) and to prevent its displacement during the vertical oscillation of the mattress support portions.

Figure 4:
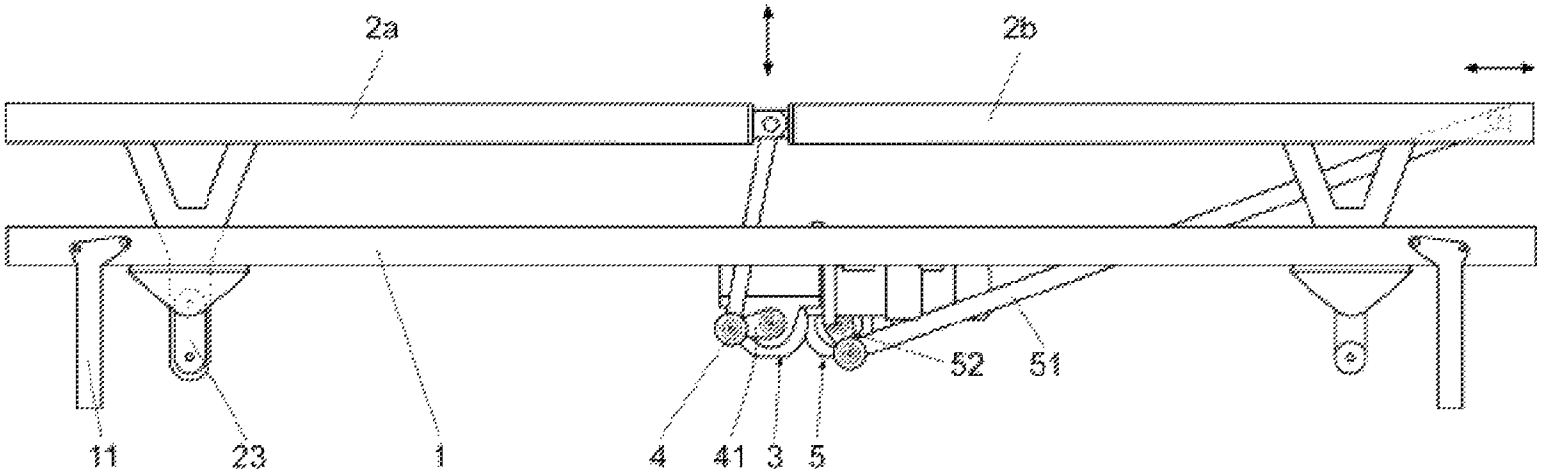
FIG. 4 shows a side view of an embodiment variant of the bed provided additionally with a second geared motor for transmitting a longitudinal alternating movement to the mattress support portions.

In the embodiment variant shown in FIG. 4, the bed additionally has a second geared motor (5) the shaft of which is associated with one of the opposite ends of one of the mattress support portions (2*b*) by means of a connecting rod-crank mechanism (51, 52) responsible for transmitting an alternating movement in the longitudinal direction to the mattress support portions (2*a*, 2*b*).

In this embodiment the two mattress support portions (2*a*, 2*b*) are articulated to the frame (1) at opposite ends by means of respective hinge rods (23), wherein the hinge rods comprise two pivot axes and a connecting bar which allow absorbing the length differences of the assembly formed by the mattress support portions during the vertical alternating movement thereof and/or the longitudinal alternating movement thereof.

Having sufficiently described the nature of the invention as well as a preferred embodiment, it is stated for all intents and purposes that the materials, shape, size and arrangement of the elements described may be modified, provided that this does alter the essential features of the invention that are claimed below.

The invention claimed is:

1. An articulated bed comprising a stationary frame having first and second outer ends and extending in a plane substantially the length of the bed, first and second mattress support portions, each of said mattress support portions arranged on the frame having an inner end, said inner ends articulately connected to each other by a common shaft, the first mattress support portion being articulated by means of hinges to one end of the frame and the second mattress support portion, being articulated by means of hinge rods to the opposite end of the frame, wherein the hinge rods comprise two pivot axes and a connecting bar, the articulated bed also comprising a geared motor assembled in the frame which rotationally operates a transverse shaft provided with at least one crank coupled by means of a connecting rod with the common shaft for the articulation of the two mattress support portions, transmitting a vertical oscillation to the common shaft and to the inner ends of the mattress support portions articulately connected by said common shaft.

2. The bed of claim 1 wherein said motor has an output shaft and wherein said crank assembly comprises first and second cranks fixed proximate different ends of said motor output shaft.

3. The bed of claim 1 wherein said mattress supporting portions are supported only by said hinges and said hinge rods.

4. The bed of claim 1 further comprising frame support legs.

5. The bed of claim 1 further comprising means extending from said mattress support portions for preventing displacement of a mattress situated on said mattress support portions.

6. An articulated bed comprising a stationary frame extending in a plane substantially the length of the bed, first and second mattress support portions, each of said mattress support portions having an inner end and an outer end, a common shaft connecting said inner ends of said mattress support portions to each other, said outer end of each of said mattress support portions being connected to said frame by first and second hinge rods, respectively, wherein the hinge rods comprise two pivot axes and a connecting bar, a first motor with an output, a first crank assembly connected between said output of said first motor and said common shaft, a second motor having an output, and a second crank assembly connected between said output of said second motor and a point on one of said mattress support portions proximate said outer end thereof.

* * * * *